US010697205B2

(12) United States Patent
Ishiguro et al.

(10) Patent No.: US 10,697,205 B2
(45) Date of Patent: Jun. 30, 2020

(54) VEHICLE DOOR LATCH DEVICE

(71) Applicant: GECOM CORPORATION, Greensburg, IN (US)

(72) Inventors: Katsuyuki Ishiguro, Novi, MI (US); Bryan Farris, Livonia, MI (US)

(73) Assignee: GECOM Corporation, Greensburg, IN (US)

( * ) Notice: Subject to any disclaimer, the term of this patent is extended or adjusted under 35 U.S.C. 154(b) by 435 days.

(21) Appl. No.: 15/433,885

(22) Filed: Feb. 15, 2017

(65) Prior Publication Data

US 2018/0230715 A1 Aug. 16, 2018

(51) Int. Cl.
*E05B 77/06* (2014.01)

(52) U.S. Cl.
CPC ..... *E05B 77/06* (2013.01)

(58) Field of Classification Search
CPC ..... E05B 77/06; E05B 77/02; E05B 77/04; E05B 77/36; E05B 77/38; E05B 77/40; E05B 77/42
USPC .. 292/201, 216, DIG. 22, DIG. 38, DIG. 23, 292/DIG. 56, DIG. 57
See application file for complete search history.

(56) References Cited

U.S. PATENT DOCUMENTS 9,920,555 B2 * 3/2018 Brickner ..... E05B 77/12
2012/0313385 A1 * 12/2012 Akizuki ..... E05B 85/26 292/216
2014/0319852 A1 * 10/2014 Shimura ..... E05B 79/08 292/216

FOREIGN PATENT DOCUMENTS

WO WO2014/111818 A2 7/2014
WO WO-2014111818 A2 * 7/2014 ..... E05B 77/12

* cited by examiner

*Primary Examiner* — Kristina R Fulton
*Assistant Examiner* — Thomas L Neubauer
(74) *Attorney, Agent, or Firm* — Klarquist Sparkman, LLP

(57) ABSTRACT

A vehicle door latch device comprises a latch; a ratchet for releasing the latch; a first lever that can rotate in a releasing direction from an initial position due to releasing of the ratchet, a synthetic resin part being fixed to a metal part on the first lever; a first spring biasing the first lever toward the initial position, a second lever pivotally mounted to the first lever via a second shaft at a certain angle and rotating from the initial position to a block position for preventing the first lever from rotating in a releasing direction; a second spring comprising a torsion spring for biasing the second lever toward the initial position; and a holding member made of the synthetic resin part and holding a coil of the second spring.

2 Claims, 8 Drawing Sheets

VEHICLE DOOR LATCH DEVICE

BACKGROUND OF THE INVENTION

The present invention relates to a vehicle door latch device for preventing a door from opening if a door panel is deformed by a crash.

A conventional vehicle door latch device is disclosed in JP2016-505098A.

The vehicle door latch device in JP2016-505098A comprises a latch ("rotary catch" in JP2016-505098A) that can engage with a striker; a ratchet ("pawl") that can engage with the latch; an opening lever ("open lever") for releasing the ratchet; a first lever ("inertia lever") pivotally mounted to a base; a second lever ("preventing lever") pivotally mounted to the first lever; and a safety lever that contacts an outer periphery of the first lever forcedly and applies a resistance to rotation of the first lever. When a door handle is operated manually, the first lever and the second lever rotate around the first lever together, and when the opening lever is rotated at an excessive speed by a crash, the second lever moves to a position where it can contact the safety lever, thereby preventing the ratchet from rotating and the door from opening.

However, the vehicle door latch device in JP2016-505098A applies a resistance to rotation of the first lever by contacting the periphery of the first lever forcedly. Due to dust and frozen rain water in a gap between the periphery of the first lever and the safety lever, a resistance to the first lever is excessive, and when a door handle is operated manually, the second lever moves to a position where it prevents the first lever from rotating, so that the door cannot be opened.

SUMMARY OF THE INVENTION

In view of the disadvantages, it is an object of the invention to provide a vehicle door latch device for preventing a door from opening if a door panel is deformed by a crash, while the door can be opened securely with a door handle manually.

DETAILED DESCRIPTION OF PREFERRED EMBODIMENT

One embodiment of the present invention will be described with respect to the drawings as below.

Figure 1:
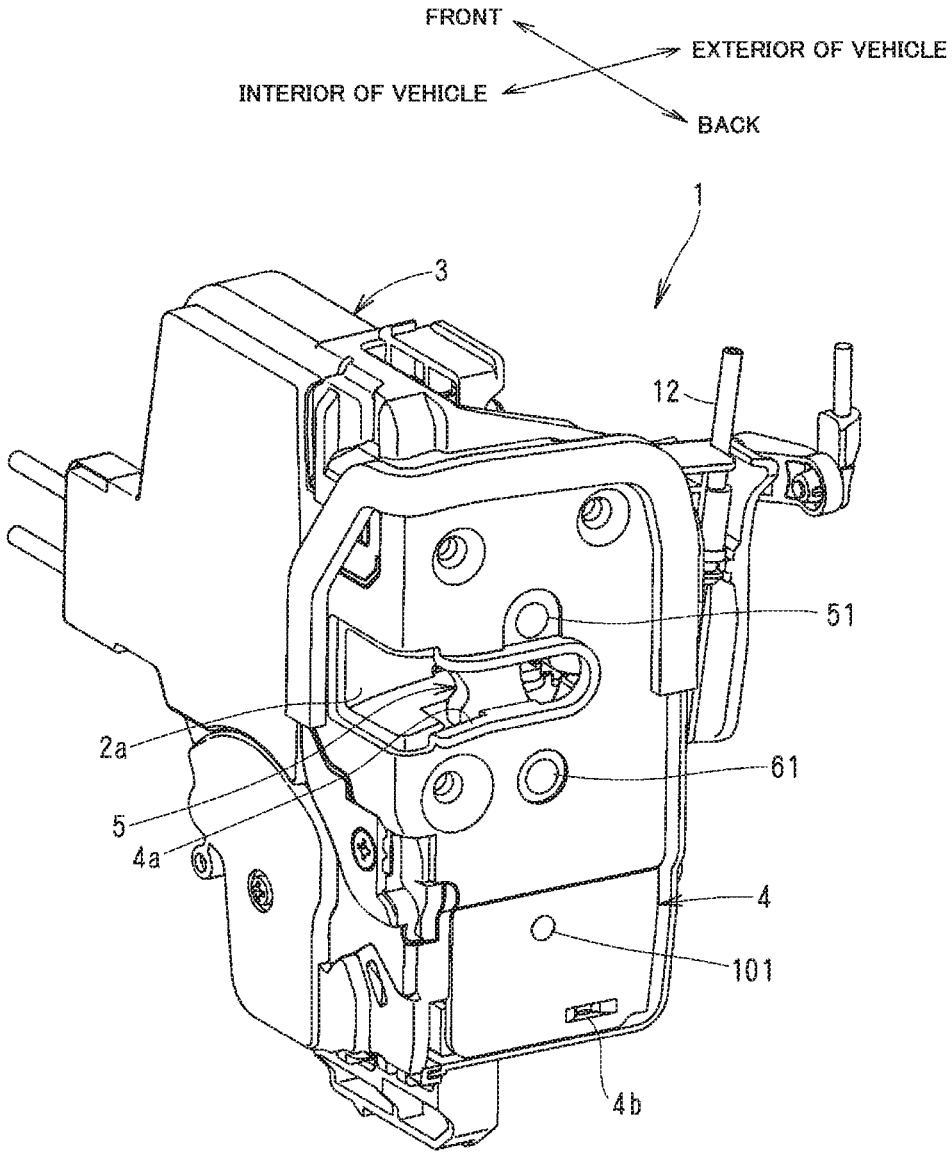
FIG. 1 is a front perspective view of a vehicle door latch device according to the present invention.
Figure 2:
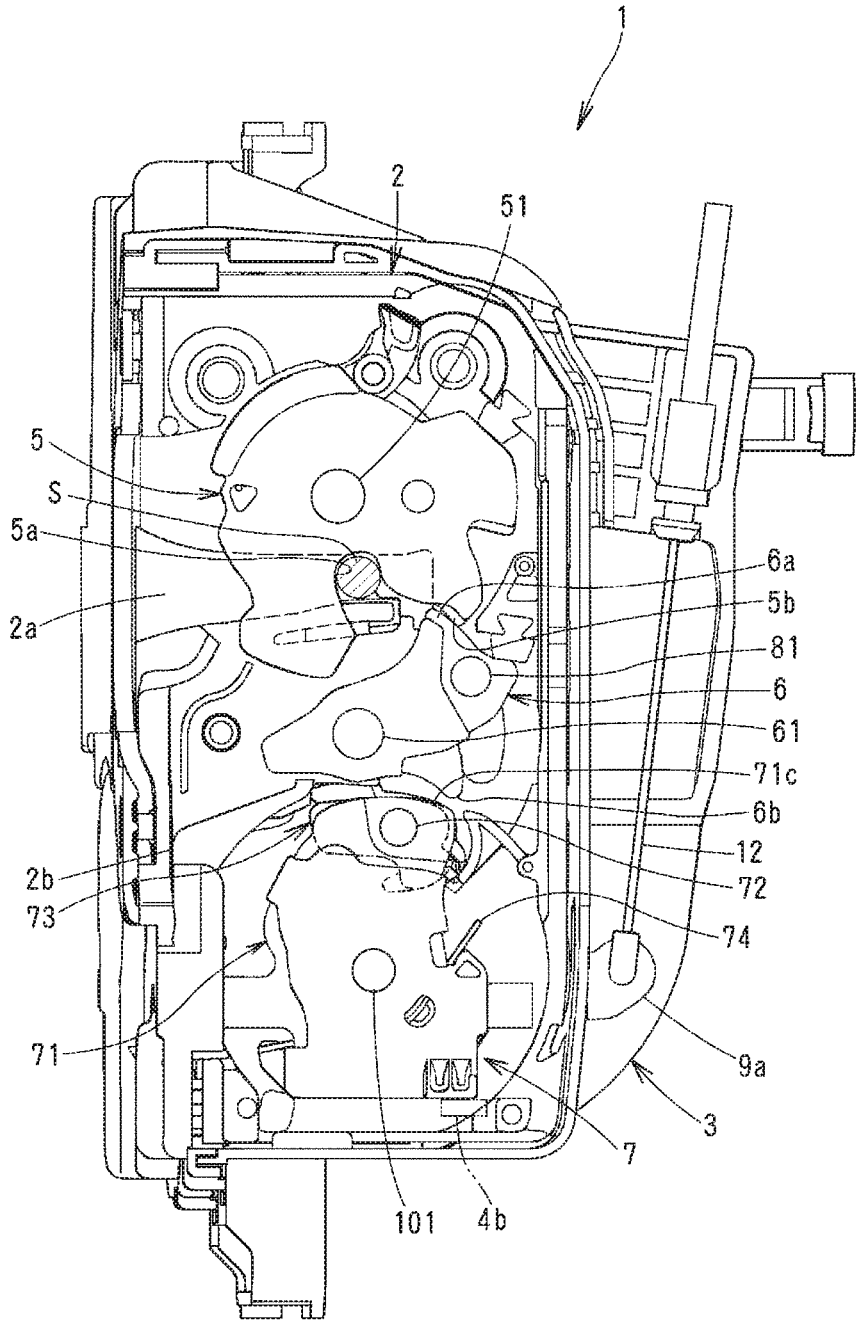
FIG. 2 is a front elevational view of an engagement unit.
Figure 3:
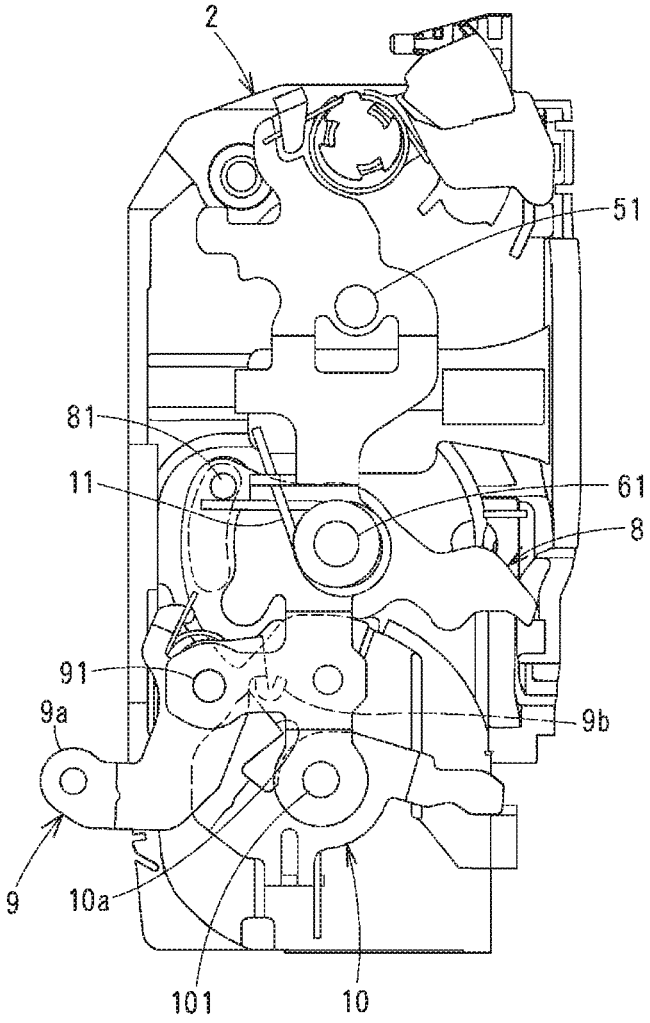
FIG. 3 is a back elevational view of the engagement unit.

FIG. 1 is a perspective view of a vehicle door latch device 1; FIG. 2 is a front elevational view of an engagement unit; and FIG. 3 is a back elevational view of the engagement unit. A left side, a right side, a front and a back in the following description correspond to an interior, an exterior, a back and a front of a vehicle when the vehicle door latch 1 is attached in a door.

The vehicle door latch device 1 comprises the engagement unit disposed at a rear end in a front door pivotally mounted around a vertical hinge shaft to open and close at a vehicle body side, with an engagement-mechanism housing 2 having an engagement mechanism (later described) which engages with a striker S of a vehicle body to hold the door closed, and an operation unit with an operating-mechanism housing 3 having a locking mechanism (not shown) and other elements.

On an outer side of the door, there are disposed a key cylinder (not shown) for manual locking and unlocking and an outside door handle (not shown) for opening the door outside the vehicle, and on an inner side, there is disposed a locking knob (not shown) for manual locking and unlocking and an inside door handle (not shown) for opening the door inside the vehicle.

The operating-mechanism housing 3 of the operation unit is fixed to the engagement-mechanism housing 2 covering a back of the engagement-mechanism housing 2. Inside the operating-mechanism housing 3, there is disposed the locking mechanism (not shown) for turning a unlocking state where the door can be opened with the outside door handle or the inside door handle through manual locking/unlocking action (with the key cylinder or the locking knob) or electric driving due to remote control of a portable device and a locking state where the door cannot be opened.

The engagement unit comprises the synthetic-resin engagement-mechanism housing 2 closed with a metal cover member 4 over a front. The engagement-mechanism housing 2 is a base member in the present invention, and includes in a space formed by the engagement-mechanism housing 2 and the cover member 4, an engagement mechanism including a latch 5 that can engage with the striker S and a ratchet 6 that can engage with the latch 5, and a crash-release preventing mechanism 7 for preventing the ratchet 6 from releasing or disengaging from the latch 5 when a door panel is deformed by a crash.

In FIG. 3, at the back of the engagement-mechanism housing 2, there are disposed an opening lever 8 rotating with the latch 5, a first outside lever 9 connected to the outside door handle, and a second outside lever 10 moving with the first outside lever 9. The engagement-mechanism housing 2 is fixed to the door with a plurality of bolts (not shown) such that the cover member 4 faces an inner surface of a rear end of the door.

The latch 5 is pivotally mounted to the engagement-mechanism housing 2 via a latch shaft 51 that lies longitudinally of the vehicle. With a door-closing motion, the striker S comes into striker-entering grooves 2*a*, 4*a* of the engagement-mechanism housing 2 and the cover member 4 and engages in the engagement groove 5*a*. The latch 5 rotates counterclockwise at a certain angle against a spring (not shown) acting on the latch 5 from an open position where it rotates clockwise from a position in FIG. 2 by approximately 90 degrees, to a full-latch position in FIG. 2, and rotates reversely with a door-opening motion. FIG. 2 is shown without the cover member 4 to show an internal structure of the engagement unit.

The ratchet 6 is pivotally mounted to the engagement-mechanism housing 2 via a ratchet shaft 61 extending longitudinally of the vehicle, and is biased by a spring 11 acting on the opening lever 8 in an engaging direction or counterclockwise. In FIG. 2, a pawl 6*a* engages with a full-latch engagement portion 5*b* of the latch 5 to hold the latch 5 in a full-latch position where the door is fully closed. The pawl 6*a* is released clockwise against the biasing force of the spring 11 from an engagement position where the pawl 6*a* engages with the full-latch engagement portion 5*b*, and the pawl 6*a* disengages from the full-latch engagement portion 5*b* in FIG. 6 to enable the door to open.

The opening lever 8 is pivotally mounted via the ratchet shaft 61 at the back of the engagement-mechanism housing 2 and is coupled to the ratchet 6 via a coupling pin 81 to rotate with the ratchet 6.

In FIG. 3, the first outside lever 9 is pivotally mounted at a lower part of the back of the engagement-mechanism housing 2 via a shaft 91. The first outside lever 9 is connected at one end 9*a* to the outside handle via a vertical Bowden cable 2 in FIGS. 1 and 2 and rotates at a certain angle in a releasing direction or clockwise seen from the back around the shaft 91 due to a door-opening action of the outside handle. The rotation is transmitted to the second outside lever 10.

The second outside lever 10 is pivotally mounted via a first shaft 101 at a lower part of the back of the engagement-mechanism housing 2, comes in contact with a bent portion 9*b* of the first outside lever 9 at an end 10*a*, and is rotated by a certain angle around a shaft 101 in a releasing direction or counterclockwise seen from the back. Hence, the opening lever 8 and the ratchet 6 are released by a locking mechanism (not shown), so that the door can be opened.

Figure 4:
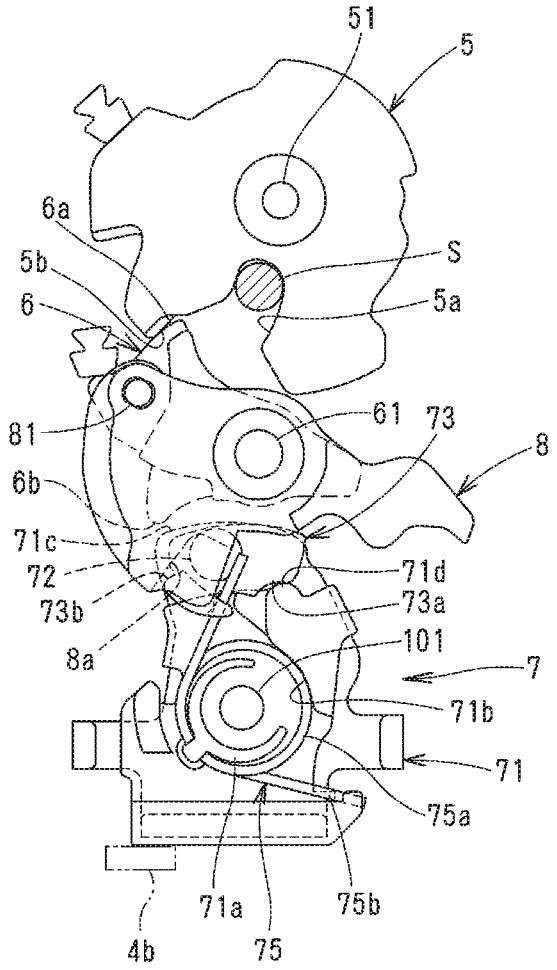
FIG. 4 is a back elevational view of a main part of the engagement unit.
Figure 5:
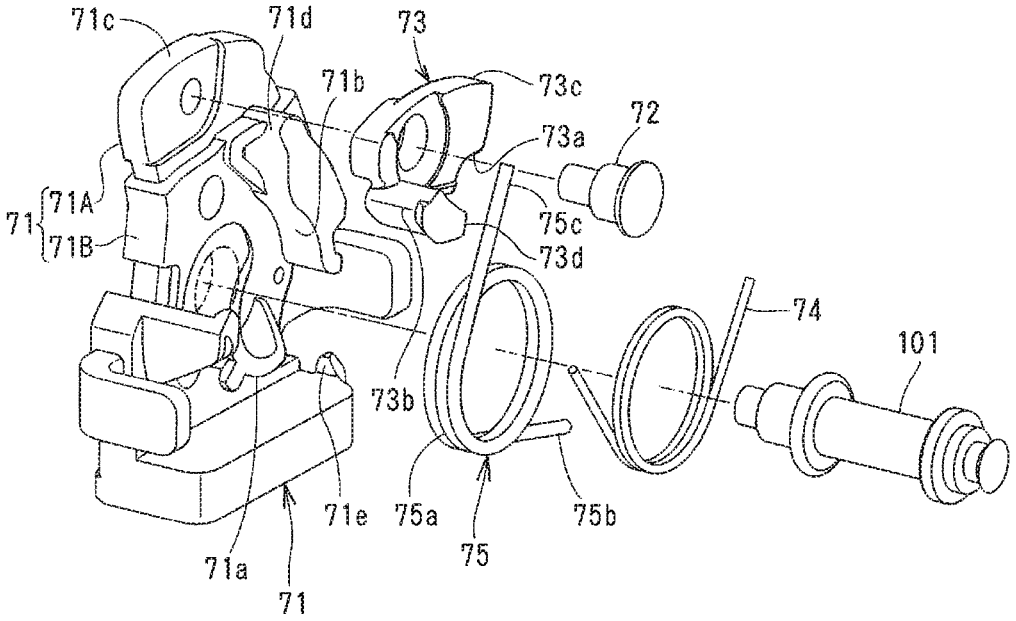
FIG. 5 is an exploded perspective view of a crash-release preventing mechanism.
Figure 6:
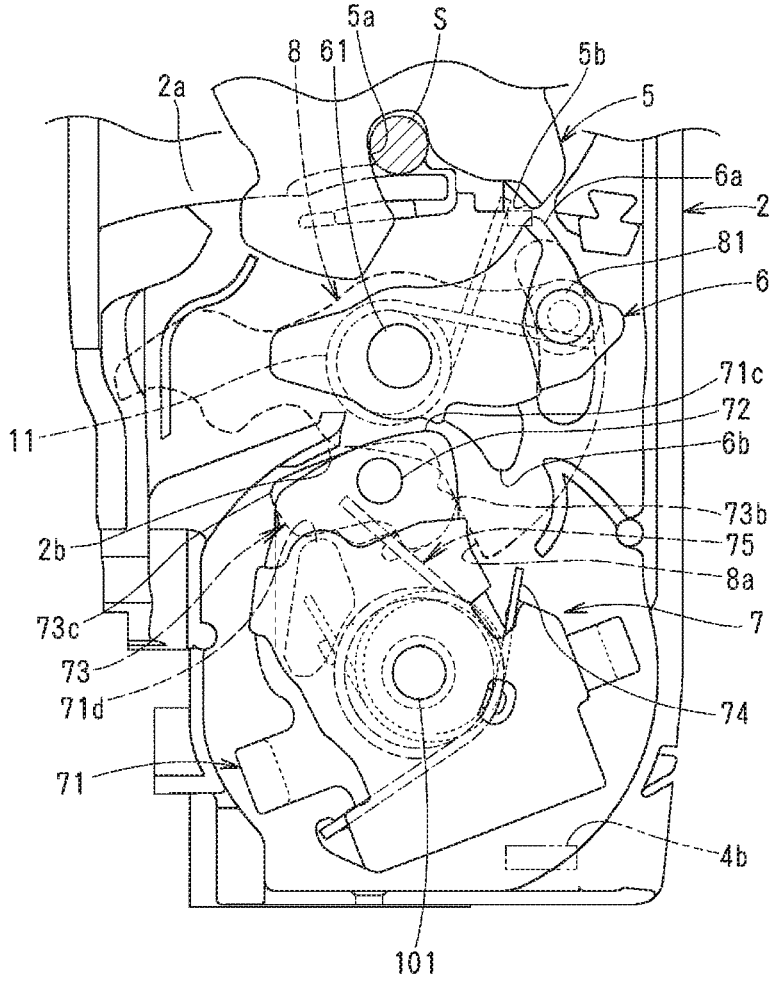
FIG. 6 is a front elevational view for explaining a motion of the crash-release preventing mechanism when it is released manually.
Figure 7:
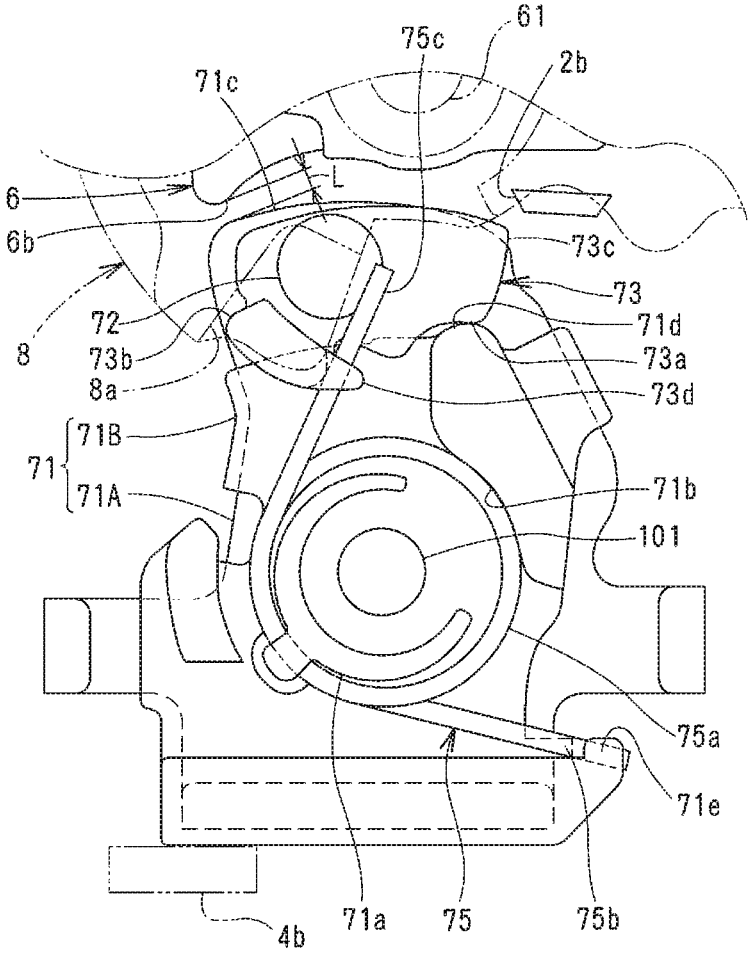
FIG. 7 is an enlarged back elevational view of the crash-release preventing mechanism in an initial state.
Figure 8:
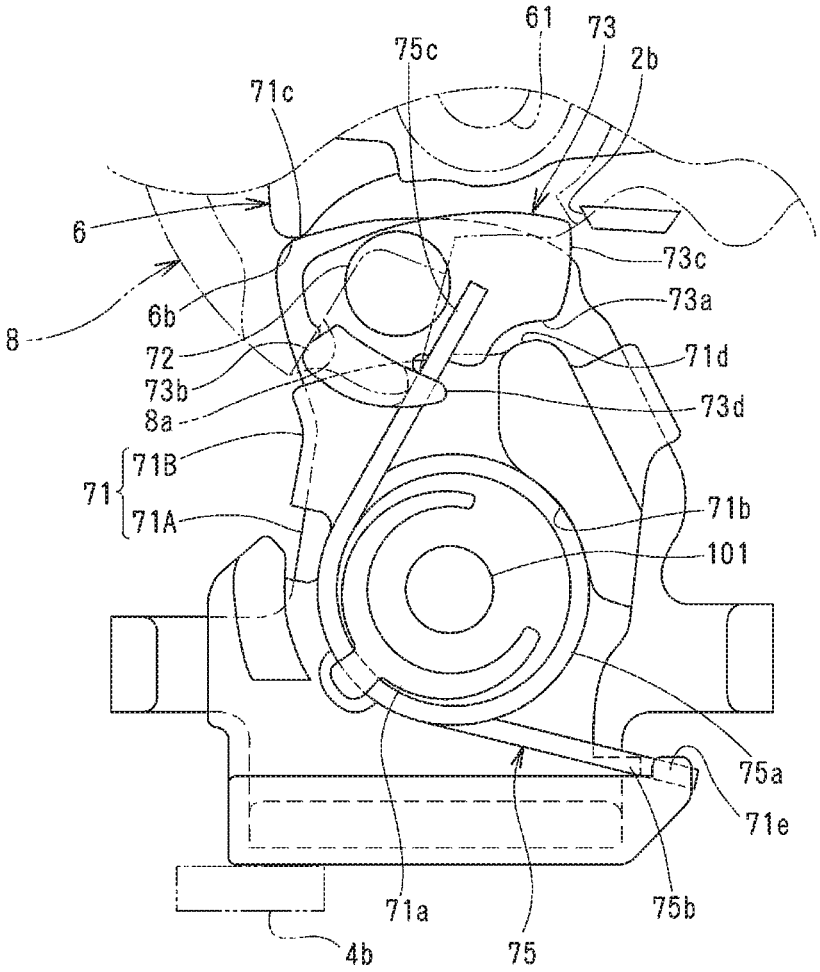
FIG. 8 is an enlarged back elevational view of the crash-release preventing mechanism in a block state.

FIG. 4 is a back elevational view of a main part o the engagement unit; FIG. 5 is an exploded perspective view of the crash-release preventing mechanism 7; FIG. 6 is a front elevational view for explaining a motion of the crash-release preventing mechanism 7 when it is released manually; FIG. 7 is an enlarged back elevational view of the crash-release preventing mechanism 7 in an initial state; and FIG. 8 is an enlarged back elevational view of the crash-release preventing mechanism 7 in a block state.

The crash-release preventing mechanism 7 comprises a first lever 71 pivotally mounted to the engagement mechanism housing 2 via a first shaft 101 coaxial with the second outside lever 10, a second lever 73 made of synthetic resin and pivotally mounted to an upper part of the first lever 71 via a second shaft 72; a first spring 74 that is a torsion spring acting on the first lever 71, and a second spring 75 that is a torsion spring acting on the second lever 73.

In the first lever 71, a synthetic resin part 71B is partially fixed around a metal part 71A and held in an initial position where a right lower end comes in contact with a stopper portion 4*b* of the cover member 4 clockwise by a biasing force of the first spring 74 in an initial state in FIG. 2.

In a subassembly state where the second lever 73 and the second spring 75 are connected to the first lever 71, the first lever 71 is formed such that a center of gravity is positioned at a center of rotation or an axis of the first shaft 101. Even if an inertia force or acceleration exerts from any directions through a crash, the first lever 71 in the subassembly state is held in the initial position without rotating.

In FIGS. 5, 7 and 8, the first lever 71 comprises an inner convex holding portion 71*a* and an outer concave holding portion 71*b* around the first shaft 101 for holding the second spring 75 made of the synthetic resin part 71B. The inner holding portion 71*a* and/or the outer holding portion 71*b* constitute a holding member according to the present invention.

In FIG. 7 where the first lever 71 is held in the initial position, there is a slight gap L between an arc-shaped preventing portion 71*c* (the arc is part of a circle around a position by about 2 mm leftward of the first shaft 101) on an upper edge of the first lever 71 and an edge of a pawl-shaped contact portion 6*b* at an lower edge of the ratchet 6. The gap L is determined to be smaller than an engagement allowance with which the pawl 6*a* of the ratchet 6 engages with the full-latch engagement portion 5*b* of the latch 5.

In FIG. 8, when the opening lever 8 is moved in a releasing direction at an excessive speed by the crash, the contact portion 6*b* of the ratchet 6 comes in contact with the preventing portion 71*c* of the first lever 71, and a line of action of a force exerting on the preventing portion 71*c* deviates leftward from the center of rotation of the first lever 71 in FIG. 8. Thus, when the contact portion 6*b* of the ratchet 6 is in contact with the preventing portion 71*c* of the first lever 71 resting in the initial position, a force opposite a releasing direction from the initial position exerts on the first lever 71, thereby preventing the ratchet 6 from moving further in the releasing direction, so that the pawl 6*a* of the ratchet 6 does not disengage from the full-latch engagement portion 5*b* of the latch 5.

The first spring 74 engages at one end with the engagement-mechanism housing 2 and at the other end with the first lever 71, thereby applying a clockwise biasing force to the first lever 71 around the first shaft 101.

The second lever 73 is pivotally mounted over the first lever 71 via the second shaft 72 and is held in the initial position where a lower portion 73*a* is in contact with a stopper portion 71*d* at the back of the first lever 71 by the synthetic resin part 71B in the initial state in FIGS. 2, 4 and 7.

When the second lever 73 is held in the initial position, the second lever 73 is held in a posture where the second lever 73 does not come in contact with a stationary stopper 2*b* of the engagement-mechanism housing 2 so that the first lever 71 may be permitted to rotate in the releasing direction.

Because of deformation of the door panel caused by the crash, a releasing force acts on the outside handle and is transmitted to the opening lever 8. The contact portion 8*a* comes in contact with a contacted portion 73*b* of the second lever 73 from a left side in FIG. 8 at an excessive speed. Hence, the second lever 73 rotates to a block counterclockwise seen from the back around the second shaft 72, from the initial position in FIG. 7 to a block position in FIG. 8 against the biasing force of the second spring 75.

In FIG. 8, when the second lever 73 moves to the block position, in order to prevent the first lever 71 from rotating in the releasing direction, an upper end 73*c* projects greatly upward from an upper edge of the first lever 71 and becomes a posture where the second lever 73 can contact the stationary stopper 2*b* in a rotating direction.

In the second spring 75, while part of an inner circumferential surface of a coil 75*a* is in contact with the inner holding portion 71*a* of the first lever 71, and part of an outer circumferential surface is in contact with an outer holding portion 71*b*, the coil 75*a* is held by the synthetic-resin part 71B. One end 75*b* engages with an engaging portion 71*e* made of the synthetic-rein portion 71B, and the other end 75*c* engages with an engaging portion 73*d* of the second lever 73, thereby applying a clockwise biasing force to the second lever 73 around the second shaft 72 seen from the back. The second spring 75 is held on the first lever 71 with the synthetic-resin part 71B. Thus, the second spring 75 can stably be held, thereby applying a stable biasing force to the second lever 73 anytime.

The biasing force of the second spring 75 exerting on the second lever 73 is set to be greater than the biasing force of the first spring 74 exerting on the first lever.

Then, the crash-release preventing mechanism 7 will be described as to its function.

When the door is closed in FIGS. 2 and 4, the latch 5 is held in an engagement position where the pawl 6*a* of the ratchet 6 engages with the full-latch engagement portion 5*b* of the latch 5 in the full-latch position. The crash-release preventing mechanism 7 is in the initial state where the first lever 71 and the second lever 73 are held in the initial states respectively by the springs 74, 75.

By operating the outside handle or the inside handle manually when the crash-release preventing mechanism 7 is in the initial state and when the locking mechanism is in the unlocking state, the ratchet 6 and the opening lever 8 are released by rotating the first and second outside levers 9, 10.

By releasing the ratchet 6 and the opening lever 8 manually, the contact portion 8*a* of the opening lever 8 comes in contact with the contacted portion 73*b*. In FIG. 6, the first lever 71 rotates counterclockwise around the first lever 101, and the second lever 73 revolves counterclockwise around the first shaft 101. In this case, because the biasing force of the second spring 75 acting on the second lever 73 is greater than the biasing force of the first spring 74 acting on the first lever 71, the second lever 73 does not move from the initial position to the block position against the biasing force of the second spring 75.

Thus, when the outside handle or the inside handle is operated manually, the ratchet 6 and the opening lever 8 are released in FIG. 6 to enable the door to open.

In this case, the second spring 75 is held by the first lever 71 while the coil 75*a* is in contact with the inner holding portion 71*a* and the outer holding portion 71*b* of the synthetic-resin part 71B, thereby minimizing a change of the biasing force of the second spring 75 to the second lever 73 caused by dusts into the operating-mechanism housing 3. Thus, when the outside handle or the inside handle is operated manually, the second lever 73 revolves around the first shaft 101 securely while kept in the initial position, thereby overcoming a problem that the door cannot be opened.

When the door is closed, a door-opening force is applied to the outside handle by deforming the door panel from the crash, and the ratchet 6 and the opening lever 8 are rotated from the engagement position in the releasing direction at an excessive speed (or a speed beyond a speed when the door is opened manually). The contact portion 8*a* of the opening lever 8 comes in contact with the contacted portion 73*b* of the second lever 73 forcedly. A clockwise rotating force (seen from the back) is applied to the first lever 73, and the second lever 73 rotates immediately counterclockwise (seen from the back) around the second shaft 72 from the position in FIG. 7 against the biasing force of the second spring 75 to the block position.

The second lever 73 moves to the block position, thereby enabling the end 73*c* of the second lever 73 to contact the stationary stopper 2*b* of the engagement-mechanism housing 2 and preventing the first lever 71 from rotating in the releasing direction. Thus, the ratchet 6 and the opening lever 8 rotate slightly in the releasing direction, but are prevented from further rotating in the releasing direction, so that the pawl 6*a* of the ratchet 6 does not disengage from the full-latch engagement portion 5*b* of the latch 5.

When rotating at a speed higher than the foregoing excessive speed, the contact portion 8*a* of the opening lever 8 comes in contact with the contacted portion 73*b* of the second lever 73 more vigorously. When the ratchet 6 and the opening lever 8 moves by a distance corresponding to the gap L, the second lever 73 rotates clockwise (seen from the back) around the shaft 72 against the biasing force of the second spring 75 by a certain angle and moves to the block position in FIG. 8.

The second lever 73 moves to the block position. The end 73*c* of the second lever 73 becomes a state in which it can contact the stationary stopper 2*b* of the engagement-mechanism housing 2 in a rotating direction, and the contact portion 6*b* of the ratchet 6 comes in contact with the preventing portion 71*c* of the first lever 71 resting in the initial position. Thus, the ratchet 6 is prevented from rotating in the releasing direction.

The foregoing relates to one embodiment of the present invention. The following variations and changes may be made to the embodiments without departing from claims as below:

(a) The ratchet 6 is integrally formed with the opening lever 8.

(b) The inner holding portion 71*a* and the outer holding portion 71*b* of the first lever 71 are changed in shape.

What is claimed is:

1. A vehicle door latch device comprising:

a base member;

a latch pivotally mounted to the base member and engaging with a striker;

a ratchet pivotally mounted to the base member and releasing the latch;

a first lever pivotally mounted to the base member via a first shaft and rotating in a releasing direction based on releasing of the ratchet, the first lever comprising a holding member made of synthetic resin being fixed to a metal part on the first lever;

a first spring biasing the first lever toward an initial position;

a second lever pivotally mounted to the first lever via a second shaft and rotating from an initial position where it contacts the synthetic resin part to a block position for preventing the first lever from rotating in the releasing direction;

a second spring comprising a torsion spring for biasing the second lever toward the initial position;

the holding member holding a coil of the second spring an opening lever rotating integrally with the ratchet; and a stationary stopper provided on the base member, the stationary stopper and the first lever do not come into contact with each other, and do not come into a biasing state, a biasing force of the second spring exerting on the second lever is set to be greater than a biasing force of the first spring exerting on the first lever, when the ratchet and the opening lever are released manually, the first lever and the second lever revolve counterclockwise seen from the front around the first shaft and become rotatable in the releasing direction, wherein, because of deformation of a door panel caused by a crash, when a contact portion of the opening lever comes in contact with a contacted portion of the second lever at an excessive speed, the second lever rotates to a block position counterclockwise seen from the back around the second shaft against the biasing force of the second spring, and becomes a posture where an upper end of the second lever can contact the stationary stopper to prevent the first lever from rotating in the releasing direction.

2. The vehicle door latch device of claim 1 wherein the holding member comprises an outer concave holding portion that contacts an outer circumference of the coil of the second spring and/or an inner convex holding portion that contacts an inner circumference of the coil of the second spring.

* * * * *